US006878221B1

(12) United States Patent
Mei et al.

(10) Patent No.: US 6,878,221 B1
(45) Date of Patent: Apr. 12, 2005

(54) LEAD-FREE NONTOXIC EXPLOSIVE MIX

(75) Inventors: George C. Mei, Creve Coeur, MO (US); James W. Pickett, Gillespie, IL (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 10/462,555

(22) Filed: Jun. 16, 2003

Related U.S. Application Data

(60) Provisional application No. 60/443,790, filed on Jan. 30, 2003.

(51) Int. Cl.[7] ..... C06B 33/14; D03D 23/00

(52) U.S. Cl. ..... 149/41; 149/108.6

(58) Field of Search ..... 149/37, 41, 45, 149/108.6

(56) References Cited

U.S. PATENT DOCUMENTS

| | | | | |
|---|---|---|---|---|
| 3,741,585 A | | 6/1973 | Hendricks et al. | |
| 3,779,823 A | | 12/1973 | Price et al. | |
| 3,883,373 A | * | 5/1975 | Sidebottom | 149/45 |
| 4,184,901 A | * | 1/1980 | Tanner et al. | 149/19.6 |
| 4,363,679 A | | 12/1982 | Hagel et al. | |
| 4,419,153 A | * | 12/1983 | Boberg | 149/22 |
| 4,566,921 A | | 1/1986 | Duguet | |
| 4,581,082 A | | 4/1986 | Hagel et al. | |
| 4,674,409 A | | 6/1987 | Lopata et al. | |
| 5,167,736 A | | 12/1992 | Mei et al. | |
| 5,216,199 A | | 6/1993 | Bjerke et al. | |
| 5,381,208 A | | 1/1995 | Takagi | |
| 5,388,519 A | | 2/1995 | Guindon et al. | |
| 5,437,229 A | | 8/1995 | Taylor et al. | |
| 5,538,569 A | | 7/1996 | Carter | |
| 5,547,528 A | | 8/1996 | Erickson et al. | |
| 5,561,260 A | | 10/1996 | Towning et al. | |
| 5,567,252 A | | 10/1996 | Mei et al. | |
| 5,585,594 A | | 12/1996 | Pelham et al. | |
| 5,610,367 A | | 3/1997 | Erickson et al. | |
| 5,654,520 A | | 8/1997 | Boberg et al. | |
| 5,684,268 A | | 11/1997 | Lopata | |
| 5,717,159 A | | 2/1998 | Dixon et al. | |
| 5,739,460 A | * | 4/1998 | Knowlton et al. | 149/45 |
| 6,156,230 A | * | 12/2000 | Wheatley | 149/19.91 |
| 6,224,099 B1 | * | 5/2001 | Nielson et al. | 149/45 |
| 6,478,903 B1 | | 11/2002 | John, Jr. et al. | |

FOREIGN PATENT DOCUMENTS

| | | | |
|---|---|---|---|
| DE | 1 243 067 | 6/1967 | |
| EP | 1 216 215 B1 | 5/2004 | C06C/7/00 |
| FR | 2021662 | 7/1970 | C06C/1/00 |
| WO | WO 95/04672 | 2/1995 | B60R/21/16 |
| WO | WO 01/21558 A1 | 3/2001 | C06C/7/00 |

OTHER PUBLICATIONS

Hawley, "The Condensed Chemical Dictionary", 9th Edition, 1977, Van Nostrand Reinhold Company, New York, pp. 113–114.*

* cited by examiner

*Primary Examiner*—Aileen Felton
(74) *Attorney, Agent, or Firm*—Todd E. Garabedian; Wiggin and Dana LLP

(57) ABSTRACT

The present invention is directed to a lead-free, nontoxic pyrotechnic composition, comprising: 30–80 wt % of bismuth subnitrate; and 10–50 wt % of a fuel, wherein all weight percents are based on the total weight of the composition. The present invention is also directed to a lead-free, nontoxic priming composition, comprising: 20–80 wt % of the above nontoxic pyrotechnic composition; 20–50 wt % of an initiator explosive; and 2–10 wt % of a sensitizer, wherein all weight percents are based on the total weight of the composition.

19 Claims, No Drawings

LEAD-FREE NONTOXIC EXPLOSIVE MIX

This application claims the benefit of U.S. Provisional Application No. 60/443,790 filed Jan. 30, 2003.

BACKGROUND OF THE INVENTION

1. Field of the Invention

The present invention is directed to explosive mixes, and more particularly lead-free and non-toxic explosive mixes.

2. Brief Description of the Related Art

Various lead-free priming mixtures for use in ammunition have been disclosed over the years. For example, a nontoxic, noncorrosive priming mix described in U.S. Pat. No. 4,675,059 is one such composition. This priming composition contains diazodinitrophenol, also known as dinol or DDNP, manganese dioxide, tetrazene and glass. Another example of a nontoxic priming mixture is disclosed in U.S. Pat. No. 4,963,201, issued to Bjerke et al. This composition comprises dinol or potassium dinitrobenzofuroxan as the primary explosive, tetrazene as a secondary explosive, a nitrate ester fuel and strontium nitrate as the oxidizer. U.S. Pat. No. 5,993,577 to Erickson et al. discloses a lead-free priming composition made from diazodinitrophenol (DDNP), a low percentage of tetrazene, and a high percentage of an abrasive such as ground glass.

Many of the leadfree mixes based on dinol (DDNP), despite being "leadless", still contain toxic heavy metals such as barium and antimony. These are present in the fuels and oxidizers traditionally used in priming mixtures. Other fuels and oxidizers have also been employed, but many of them suffer from hygroscopicity, inherent moisture retention, sensitivity to moisture, unavailability, instability, and inherent processing difficulties.

Bismuth compounds have been used in various medications and personal care compositions. For example, U.S. Pat. No. 6,426,085 to Athanikar discloses use of bismuth-containing compounds in topical oral dosage forms for the treatment of halitosis. U.S. Pat. No. 6,379,651 to Athanikar discloses treatments with bismuth compounds, other antibacterial compounds, and/or antibiotics in oral-topical and peroral dosage forms to eradicate *H. pylori* order to improve the ulcer cure rate and prevent ulcer relapse. U.S. Pat. No. 6,372,784 to Athanikar discloses a method for treatment of corneal and dermal wounds by administering bismuth compounds in topical dosage forms. In addition, bismuth has been demonstrated to be an accepted non-toxic material used in non-toxic shot for waterfowl hunting.

Bismuth subnitrate (also known as bismuth nitrate basic,) has been disclosed for use as an antacid, and in compositions for regulating wrinkles or atrophy in mammalian skin (See for example U.S. Pat. Nos. 5,883,085; 5,837,697; 5,811,413; 5,795,879; and 5,780,458).

U.S. Pat. No. 6,478,903 to John, Jr. discloses a non-toxic primer mix including both bismuth sulfide and potassium nitrate as the pyrotechnic portion of the primer. However, bismuth subnitrate is not disclosed.

What is needed in the art is a lead-free, non-toxic priming composition that reduces or eliminates toxic heavy metals such as antimony and barium, yet is economical, easy to produce, and is free from the above-mentioned problems of hygroscopicity, inherent moisture retention, and moisture sensitivity. The present invention is believed to be an answer to that need.

SUMMARY OF THE INVENTION

In one aspect, the present invention is directed to a lead-free, nontoxic pyrotechnic composition, comprising: 30–80 wt % of bismuth subnitrate; and 10–50 wt % of a fuel, wherein all weight percents are based on the total weight of the composition.

In another aspect, the present invention is directed to a lead-free, nontoxic priming composition, comprising: 20–80 wt % of the above pyrotechnic composition; 20–50 wt % of an initiator explosive; and 2–10 wt % of a sensitizer, wherein all weight percents are based on the total weight of the composition.

In another aspect, the present invention is directed to a lead-free, nontoxic priming composition, comprising 25–35 w % of bismuth subnitrate; 5–10 wt % of fuel; 20–50 wt % of an initiator explosive; and 2–10 wt % of a sensitizer, wherein all weight percents are based on the total weight of the composition.

These and other aspects will become apparent upon reading the following detailed description of the invention.

DETAILED DESCRIPTION OF THE INVENTION

It has now been unexpectedly discovered by the inventors that the problem of toxic heavy metal content and moisture sensitivity in explosive mixes may be addressed by incorporation of bismuth subnitrate as an oxidizer in these compositions. Bismuth is a useful alternative to toxic heavy metals, such as barium or antimony, found in fuels and oxidizers in the prior art explosive mixtures. In addition, bismuth subnitrate is insoluble in water, a medium critical to safe desensitization of explosive mixes during processing.

As indicated above, in one embodiment, the present invention is directed to a lead-free, nontoxic pyrotechnic composition, comprising about 30–80 wt % of bismuth subnitrate; and about 10–50 wt % of a fuel, wherein all weight percents are based on the total weight of the composition. In another embodiment, the present invention is directed to a lead-free, nontoxic priming composition, comprising about 20–80 wt % of the above pyrotechnic composition; about 20–50 wt % of an initiator explosive; and about 2–10 wt % of a sensitizer, wherein all weight percents are based on the total weight of the composition. Each of these components are discussed in more detail below.

Bismuth subnitrate is a basic salt, the composition of which generally varies with the conditions of its preparation. Bismuth subnitrate is generally 70 to 74% bismuth or 79 to 82% $BiO_3$, and is generally prepared by partial hydrolysis of $Bi(NO_3)_3$. In the pyrotechnic composition of the present invention, bismuth subnitrate comprises about 30–80 wt % of the composition, and more preferably approximately 60 wt % of the composition. In the priming composition of the present invention, bismuth subnitrate preferably comprises about 10–40 wt % of the composition, and more preferably approximately 20 wt % of the composition.

The fuel component of the invention may be any fuel useful in the preparation of explosives or priming mixes. Examples of useful fuels include amorphous boron, metal powders, such as aluminum powder, zirconium powder, titanium powder, zinc powder, and the like; semiconductors such as carbon, silicon, and the like; metal sulfides, such as antimony sulfide, bismuth sulfide, iron sulfide, zinc sulfide, and the like; metal silicides, such as calcium silicide, copper silicide, as well as combinations of all of the above. Additional fuels and combinations thereof may also be used in the present invention. In the pyrotechnic composition of the invention, the fuel component ranges from about 10 to about 50 wt %, and more preferably about 40 wt %. In the priming composition of the invention, the fuel component preferably comprises from about 2 to about 30 wt %, and more preferably about 5 wt %.

In both embodiments, a particularly preferred fuel is boron, and particularly amorphous boron. Boron, may have an additional advantage in that it produces boric oxide as its combustion product. Boric oxide combines rapidly with moisture, also produced in the combustion process, to make boric acid. Boric acid is environmentally harmless and nontoxic. In addition, boric acid can act as a lubricant. Thus the composition of the invention may be a self lubricating primer composition which may tend to inhibit ammunition component and barrel wear.

In a preferred embodiment of the priming composition, the final concentration of fuel ranges from about 5 to about 10 wt %, and is preferably about 7 wt %, based on the total weight of the composition. The final concentration of bismuth subnitrate in this preferred embodiment ranges from about 25 to about 35 wt %, and is preferably about 28 wt %, based on the total weight of the composition.

Both the explosive embodiment and priming embodiment of the present invention may also include an optional friction agent. Friction agents useful in both embodiments of the present invention include glass particles, silicon carbide, silicon, crystalline boron, ceramics, and combinations thereof, although other friction agents and abrasives common and known in the art may also be used. In general, both embodiments of the invention may incorporate the optional friction agent in an amount ranging from about 0 to about 50 wt % of the respective compositions. Although the friction agent may be of any particle size, preferred particle sizes range from about 50 to about 150 microns.

The priming composition of the invention includes additional components such as initiator explosives, sensitizers, "fast-fuels", and the like.

Useful initiator explosives include dinol, dinitrodihydroxydiazobenzene salt (diazinate), dinitrobenzofuroxan salts, perchlorate or nitrate salt of metal complexes of ammonium, amine, or hydrazine. An example is 2-(5-cyanotetrazolato)pentaaminecobalt (III) perchlorate (CP), various diazo, triazole, and tetrazaole compounds, and combinations thereof. Preferred amounts of initiator explosive in the priming composition of the invention range from about 20 to about 50 wt %, and preferably approximately 35 wt %.

A useful sensitizers is tetrazene. Preferred amounts of sensitizer in the priming composition of the invention range from about 2 to about 10 wt %, and preferably approximately 5 wt %.

A "fast-fuel" may also be optionally included in the priming composition of the invention. Useful fast-fuels include potassium styphnate, nitrate esters such as nitrocellulose-based propellants, or PETN, and combinations thereof. Preferred amounts of fast-fuel generally range from about 0 to about 30 wt %, and preferably approximately 20 wt %.

Additional ingredients such as binders, PVA (polyvinylacetate), Karaya, Tragacanth, Guar, Gum Arabic, etc., and combinations thereof, may also be included in both the pyrotechnic composition or the priming composition of the invention.

Both boron and bismuth-subnitrate are formed in micron to sub-micron sizes in manufacturing processes. Both are readily available commercially, offering more cost efficient utilization. The boron/bismuth-subnitrate mixtures may approach the sensitivity of the meta interstitial compounds (MICs), and such mixtures are not plagued with the hazards of handling and the costs associated with producing nano-size materials.

The composition of the present invention is easily substituted for leaded priming mixtures, and can be processed using conventional techniques. The mix of the present invention can be used directly in Boxer type components without any modification. This aspect of the present invention is particularly important because shooters can reload ammunition with this type of primer without having to buy primed cases. Finally, the mix of the invention forms non-toxic products including boron oxides.

In one embodiment, the composition may be manufactured by mixing and kneading the said ingredients in a mixer similar to those used for food processing. The resulting dough (containing 10 to 30% moisture) is then rubbed against a leaf honeycombed with a matrix of holes of fixed volume. After the holes are filled and leveled, the pellets so formed are knocked out and transferred into primer cups where a foil is then added and the mix consolidated. Finally, to finish the assembly, the cups are topped with anvils that are preinstalled in battery cups. The finished primers then proceed to be dried.

In use, the charge weight of the priming mix will vary according to the loads being developed. Additionally, although the mix is developed specifically for shotshell, various versions of mix within the scope of the claims can be used also in center fire, rim fire, or other similar type of applications, for example: fuses, igniters, air bag initiators etc, even in electric or current initiated devices. In a typical shotshell application, for example, 1 oz loads, charge weight it should fall between 0.48 and 0.90 grains, and more preferably from 0.58 to 0.70 grains. Appropriate charge weights for other applications mentioned above are within the skill of the ordinary skilled practicioner.

EXAMPLES

Example 1

Preparation of a Pyrotechnic Mixture

To form a pyrotechnic mixture, appropriate amounts of each of the ingredients is sieved through a 30 mesh screen and layered on top of each other. The loose dry powders are then tumbled together in a well-grounded container until a uniform mixture is obtained. For safe processing, water or organic solvent can be added to desensitize the mixture (up to approximately 30%). To obtain a more intimate mixing for enhancing mix sensitivity, the mixture can be subjected to sonication in liquid.

Example 2

Preparation of Priming Mixture I

To form a priming mixture, desired amounts of initiating explosive, sensitizer, and fast fuel(s) are weighed wet for obvious safety reasons. The mixture is de-watered to form a wet cake called premix. The premix is then transferred to the bowl of a mixer, and the dry ingredients including fuels, oxidizers, friction agents, and binders are layered sequentially on top of the premix. Water is added to adjust for the final moisture (up to approximately 30%). Finally, the operator leaves the room and the mixing is done remotely. When the mixing is complete, the mixture should have a consistency of flour dough.

Example 3

Preparation of Priming Mixture II

Using the procedure outlined in Example 2, a priming mixture was prepared having the following final concentrations:

| Ingredient | Amount (final wt %) |
|---|---|
| Dinol | 30 |
| Tetrazene | 5 |
| Potassium Styphnate (monosubstituted) | 15 |
| Boron | 7 |
| Bismuth Subnitrate | 28 |
| Glass fines | 15 |

The above mixture was formed into a shotshell primer using conventional techniques, and tested as follows.

A primer held in a fixture is butted against a firing pin on which a 2 oz steel ball is dropped from various heights. SAAMI (Small Arms and Ammunition Manufacturers Institute) requirements are no fire below a one inch height and all fire above 11 inches drop height for small pistol primers. This test is an industry production standard test. The heights cover a range from 0% fire to 100% fire. Then, through statistic means, the 50% fire height (H bar) and spread (S) is calculated. When primers were dropped in headed shells, the composition of Mixture II above gave H bar of 5.38" and S of 1.09", while control ("leaded") primer gave H bar of 5.64" and S of 1.04". When primer was supported in a steel die, Mixture II gave a H bar of 3.02" and S of 0.81, well within the typical range of a leaded counter part. As shown in the above data, the shotshell primer made from this mix when tested in the form of headed shells or by itself yielded sensitivity equal to those of the regular leaded primer.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entireties.

What is claimed is:

1. A lead-free, nontoxic priming composition, comprising:

20–80 wt % of a nontoxic pyrotechnic composition comprising (a) 30–80 wt % of bismuth subnitrate and (b) 10–50 wt % of a fuel;

20–50 wt % of an initiator explosive; and

2–10 wt % of a sensitizer;

wherein all weight percents are based on the total weight of said composition, and wherein said composition is substantially lead-free and substantially nontoxic.

2. The lead-free, nontoxic priming composition of claim 1, wherein said initiator explosive is selected from the group consisting of dinol, dinitrodihydroxydiazobenzene salt (diazinate), dinitrobenzofuroxan salts, 2-(5-cyanotetrazolato)pentaaminecobalt (III) perchlorate (CP), and combinations thereof.

3. The lead-free, nontoxic priming composition of claim 1, wherein said initiator explosive comprises approximately 35 wt % of said composition.

4. The lead-free, nontoxic priming composition of claim 1, wherein said sensitizer is tetrazene.

5. The lead-free, nontoxic priming composition of claim 1, wherein said sensitizer comprises approximately 5 wt % of said composition.

6. The lead-free, nontoxic priming composition of claim 1, further comprising a fast-fuel.

7. The lead-free, nontoxic priming composition of claim 6, wherein said fast-fuel comprises from about 0 to about 30 wt % of said composition.

8. The lead-free, nontoxic priming composition of claim 7, wherein said fast-fuel comprises approximately 20 wt % of said composition.

9. The lead-free, nontoxic priming composition of claim 6, wherein said fast-fuel is selected from the group consisting of potassium styphnate, nitrocellulose-based propellants, PETN, and combinations thereof.

10. The lead-free, nontoxic priming composition of claim 1, further comprising a friction agent.

11. The lead-free, nontoxic priming composition of claim 10, wherein said friction agent comprises from about 0 to about 50 wt % of said composition.

12. The lead-free, nontoxic priming composition of claim 10, wherein said friction agent is selected from the group consisting of glass particles, silicon carbide, silicon, crystalline boron, ceramics, and combinations thereof.

13. The lead-free, nontoxic priming composition of claim 1, further comprising additional ingredients selected from the group consisting of binders, PVA (polyvinylacetate), Karaya, Tragacanth, Guar, Gum Arabic, and combinations thereof.

14. A lead-free, nontoxic priming composition, comprising:

25–35 w % of bismuth subnitrate;

5–10 wt % of fuel;

20–50 wt % of an initiator explosive; and

2–10 wt % of a sensitizer;

wherein all weight percents are based on the total weight of said composition, and wherein said composition is substantially lead-free and substantially nontoxic.

15. The lead-free, nontoxic priming composition of claim 14, wherein:

said bismuth subnitrate comprises about 28 wt % of said composition;

said fuel comprises about 7 wt % of boron;

said initiator explosive comprises about 30 wt % dinol;

said sensitizer comprises about 5 wt % tetrazene;

and wherein said composition further comprises:

about 15 wt % of a fast fuel; and about 15 wt % of a friction agent.

16. The lead-free, non-toxic priming composition of claim 15, wherein said fast fuel comprises potassium styphnate and said friction agent comprises glass particles.

17. The lead-free, nontoxic priming composition of claim 1, wherein said bismuth subnitrate comprises approximately 60–80 wt % of said nontoxic pyrotechnic composition.

18. The lead-free, nontoxic priming composition of claim 1, wherein said fuel is selected from the group consisting of amorphous boron, aluminum powder, zirconium powder, titanium powder, zinc powder, carbon, silicon, bismuth sulfide, iron sulfide, zinc sulfide, calcium silicide, copper silicide, and combinations thereof.

19. The lead-free, nontoxic priming composition of claim 1, wherein said fuel comprises approximately 20–40 wt % of said nontoxic pyrotechnic composition.

* * * * *